US007945054B2

(12) United States Patent
Kim

(10) Patent No.: US 7,945,054 B2
(45) Date of Patent: May 17, 2011

(54) METHOD AND APPARATUS TO REPRODUCE WIDE MONO SOUND

(75) Inventor: Sun-min Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1448 days.

(21) Appl. No.: 11/392,750

(22) Filed: Mar. 30, 2006

(65) Prior Publication Data

US 2007/0019812 A1 Jan. 25, 2007

(30) Foreign Application Priority Data

Jul. 20, 2005 (KR) ..... 10-2005-0065704

(51) Int. Cl.
*H04R 5/00* (2006.01)
*H04R 5/02* (2006.01)

(52) U.S. Cl. ..... 381/17; 381/1; 381/18; 381/19; 381/310; 381/27

(58) Field of Classification Search ..... 381/1, 17–19, 381/302–310
See application file for complete search history.

(56) References Cited

U.S. PATENT DOCUMENTS

| | | | | |
|---|---|---|---|---|
| 4,219,696 | A | 8/1980 | Kogure et al. | |
| 5,301,236 | A | 4/1994 | Iizuka et al. | |
| 6,442,277 | B1 * | 8/2002 | Lueck et al. | 381/17 |
| 6,498,857 | B1 | 12/2002 | Sibbald | |
| 6,636,608 | B1 | 10/2003 | Kishii et al. | |
| 7,167,567 | B1 * | 1/2007 | Sibbald et al. | 381/17 |

FOREIGN PATENT DOCUMENTS

| | | |
|---|---|---|
| EP | 0554031 | 8/1993 |
| JP | 2001-186600 | 1/2001 |
| JP | 2004-056168 | 2/2004 |
| KR | 1020010001993 | 1/2001 |
| RU | 2183355 | 6/2002 |

OTHER PUBLICATIONS

Russian Office Action dated Dec. 21, 2007 issued in RU 2006126231.

* cited by examiner

*Primary Examiner* — Devona E Faulk
(74) *Attorney, Agent, or Firm* — Stanzione & Kim, LLP

(57) ABSTRACT

A wide mono sound reproducing method and apparatus to widen mono sound by using 2 channel speakers. The method include separating an input mono sound signal into a plurality of decorrelated signals, generating virtual sound sources by localizing each of the separated signals at virtual locations asymmetrical about a center of a front side of a listening point by applying different head related transfer functions to the separated signals, and canceling crosstalk of the generated virtual sound sources.

17 Claims, 4 Drawing Sheets

METHOD AND APPARATUS TO REPRODUCE WIDE MONO SOUND

CROSS-REFERENCE TO RELATED APPLICATIONS

This application claims the benefit of Korean Patent Application No. 2005-65704, filed on Jul. 20, 2005, in the Korean Intellectual Property Office, the disclosure of which is incorporated herein in its entirety by reference.

BACKGROUND OF THE INVENTION

1. Field of the Invention

The present general inventive concept relates to an audio reproducing system, and more particularly, to a wide mono sound reproducing method and system to widen mono sound, using 2 channel speakers.

2. Description of the Related Art

Generally, mono sound is reproduced through a single channel, but recently technology for synthesizing virtual stereo sound from mono sound has been under development.

Technology related to a mono sound reproduction system is described in U.S. Pat. No. 6,590,983 B1, entitled "Apparatus and method for synthesizing pseudo-stereophonic outputs from a monophonic input."

FIG. 1 is a block diagram illustrating a conventional mono sound reproducing system. Referring to FIG. 1, a signal M is provided to a left all-pass filter 102 and a right all-pass filter 104. The left all-pass filter 102 is a phase lead filter that generates a leading phase shift of +45 degrees. The right all-pass filter 104 is a phase lead filter that generates a leading phase shift of −45 degrees. The output of the left-all pass filter 102 is provided to a first input of an adder 120 and a non-inverting input of an adder 122. The output of the right all-pass filter 104 is provided to a second input of the adder 120 and an inverting input of the adder 122. The output of the adder 122 is provided to a non-inverting input of an adder 126.

The output of the right all-pass filter 104 is also provided to an input of a perspective filter 124. The output of the perspective filter 124 is provided to an inverting input of the adder 126 and a second input of an adder 128. Also, the output of the left all-pass filter 102 is provided to a non-inverting input of the adder 126 and a third input the adder 128. The output of the adder 128 is provided to a high-pass filter 108 and a first input of an adder 106. The output of the adder 126 is provided to a high-pass filter 110 and a second input of the adder 106. The output of the adder 106 is provided as a low-pass filter 109.

The output of the high-pass filter 108 is provided to a first input of an adder 112, and the output of the low-pass filter 109 is provided to a second input of the adder 112. The output of the adder 112 is provided to an input of a left channel output amplifier 116, and the output of the left channel amplifier 116 is provided to a left channel output.

The output of the high-pass filter 110 is provided to a first input of an adder 114 and the output of the low-pass filter 109 is provided to a second input of the adder 114. The output of the adder 114 is provided to an input of a right channel output amplifier 118, and the output of the right channel amplifier 118 is provided as a right channel output.

Accordingly, the conventional wide mono sound reproduction system as illustrated in FIG. 1 processes a differential signal component generated from left and right input signals in order to generate a stereo sound image. The differential signal is processed by equalization characterized by audible frequency amplification of a low band and high band. The processed differential signal is coupled (i.e., added) with the left and right input signals, and the added signal generated from the original left and right signals.

Accordingly, in the conventional wide mono sound reproduction system, input mono sound is divided into different frequency bands, and levels of the divided bands are corrected and are then recombined. However, since a head and earflap of a listener, which perform important roles in recognizing a direction of a sound source, are not considered at all, performance of the conventional wide mono sound reproduction system is poor. Also, since the conventional wide mono sound reproduction system changes phases when generating two decorrelated signals from the input mono sound, a timbre can be changed.

SUMMARY OF THE INVENTION

The present general inventive concept provides a wide mono sound reproducing method and system by which input mono sound is divided into a plurality of decorrelated signals and each signal is reproduced through one of a plurality of virtual speakers formed by using different HRTFs.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing a wide mono sound reproducing method including separating an input mono sound signal into a plurality of decorrelated signals, generating virtual sound sources by localizing the respective separated signals at virtual locations asymmetrical about a listening point by applying different head related transfer functions to the respective separated signals, and canceling crosstalk of the generated virtual sound sources.

The foregoing and/or other aspects of the present general inventive concept may also be achieved by providing a wide mono sound reproducing method including separating an input mono sound signal into a plurality of decorrelated signals, performing a widening filtering operation by generating virtual sound sources by localizing each of the respective separated signals at virtual locations asymmetrical about a center of a listening point by applying different head related transfer functions to respective separated signals, and canceling crosstalk of the separated signals localized at the virtual locations, and performing a direct filtering operation to adjust signal characteristics between the input mono sound signal and the crosstalk-cancelled virtual sound sources.

The widening filtering operation may be performed according to the following equation:

$$\begin{bmatrix} W_{11} & W_{12} \\ W_{21} & W_{22} \end{bmatrix} = \begin{bmatrix} C_{11} & C_{12} \\ C_{21} & C_{22} \end{bmatrix} \begin{bmatrix} B_L(\theta_1) + B_R(\theta_2) & B_R(\theta_1) + B_L(\theta_2) \\ B_R(\theta_1) + B_L(\theta_2) & B_L(\theta_1) + B_R(\theta_2) \end{bmatrix}$$

where $W_{11}$, $W_{12}$, $W2_1$, and $W_{22}$ represent widening filter coefficients, $C_{11}$, $C_{12}$, $C_{21}$, and $C_{22}$ represent crosstalk canceller coefficients, $B_L(\theta_1)$ and $B_R(\theta_1)$ respectively represent HRTFs of a left ear and a right ear measured on a right-hand side line making an angle $\theta_1$ from a center of the listening point, and $B_L(\theta_2)$ and $B_R(\theta_2)$ respectively represent HRTFs of the left ear and the right ear measured on a right-hand side line making an angle ($\theta_2$) from the center of the listening point.

The foregoing and/or other aspects of the present general inventive concept may also be achieved by providing a wide mono sound reproducing system including a signal separation unit to separate an input mono sound signal into a plurality of decorrelated signals, a binaural synthesis unit to generate virtual sound sources by localizing each of the separated signals at virtual locations asymmetrical about a center of a listening point by applying different head related transfer functions to the respective separated signals, a crosstalk canceller unit to cancel crosstalk between the separated signals of the virtual sound sources localized at the virtual locations by the binaural synthesis unit based on a sound transfer function, a direct filtering unit to adjust signal characteristics between the input mono sound signal and the virtual sound sources crosstalk-cancelled by the crosstalk canceller unit, and an output unit to add a signal output from the direct filtering unit with the signal output from the crosstalk canceller unit and to output the added signals to left and right speakers.

The foregoing and/or other aspects of the present general inventive concept may also be achieved by providing a mono sound system, including an input single channel sound signal, and a virtual sound source generation unit to generate an input single channel sound signal to correspond to at least one of first and second actual speakers, to determine first and second signals from the input single channel sound signal and to generate a plurality of asymmetric virtual speakers to output each of the first and second signals at a wide angle with respect to the listening point of the system.

The foregoing and/or other aspects of the present general inventive concept may also be achieved by providing a single channel sound reproduction system usable in an electronic device, including a virtual sound source generation unit to receive a single channel sound signal as an input, to generate a first plurality of asymmetric virtual sound sources from a first portion of the single channel sound signal, to generate a second plurality of asymmetric virtual sound sources from a second portion of the single channel sound signal, and to combine the first and second asymmetric virtual sound sources with the input single channel sound signal to provide a combined output signal to the at least one actual speaker such that at least one actual speaker outputs the combined output signal.

The foregoing and/or other aspects of the present general inventive concept may also be achieved by providing a sound reproduction system including an input terminal to receive a mono sound signal, a unit to asymmetrically localize first and second components of the mono sound signal, a filter to filter the mono sound signal, and an output terminal to output a combined signal according to the asymmetrically localized first and second components and the filtered mono sound signal.

The foregoing and/or other aspects of the present general inventive concept may also be achieved by providing a method of reproducing a single channel sound usable in an electronic device having at least one actual speaker, including receiving a single channel sound signal to output via the at least one actual speaker, generating a first plurality of asymmetric virtual sound sources from a first portion of the single channel sound signal and generating a second plurality of asymmetric virtual sound sources from a second portion of the single channel sound signal, and combining the first and second asymmetric virtual sound sources with the input single channel sound signal to provide a combined output signal to the at least one actual speaker.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
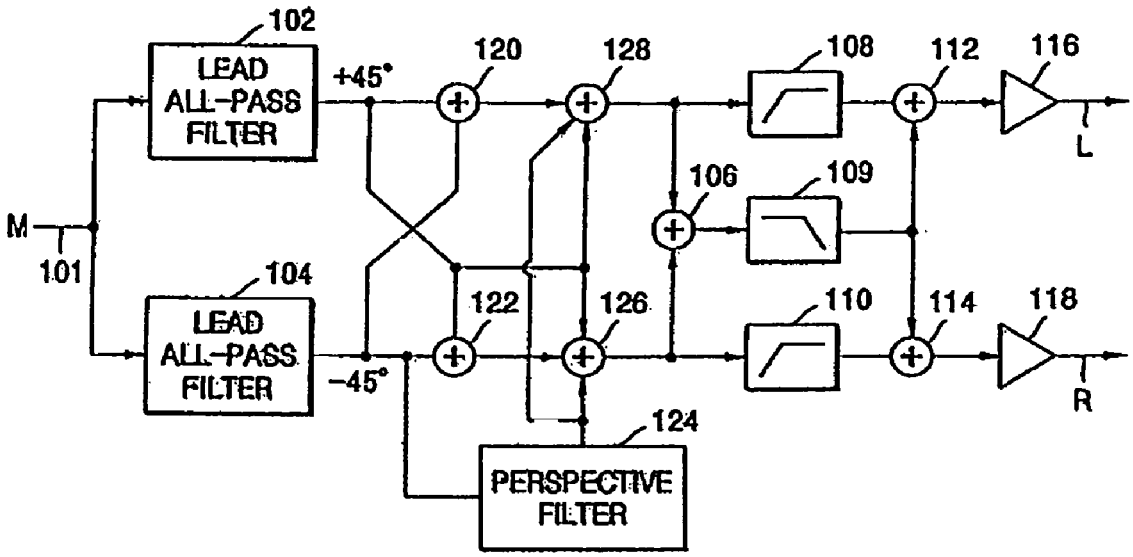
FIG. 1 (PRIOR ART)
FIG. 1 is a block diagram illustrating a conventional mono sound reproducing system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
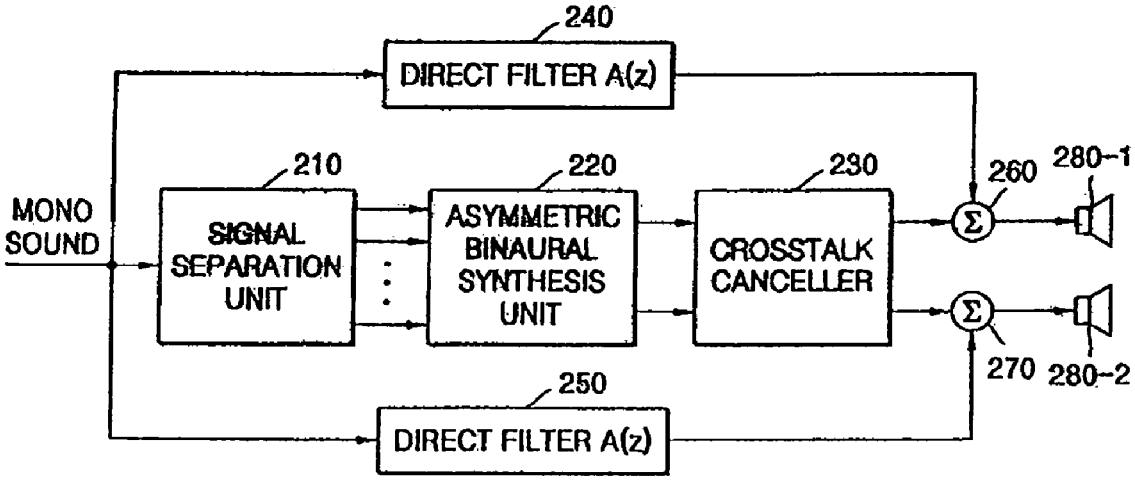
FIG. 2 is a block diagram illustrating a wide mono sound reproducing system according to an embodiment of the present general inventive concept.

A wide mono sound reproducing system according to an embodiment of the present general inventive concept, illustrated in FIG. 2, includes a signal separation unit 210, an asymmetric binaural synthesis unit 220, a crosstalk canceller 230, and left and right direct filters 240 and 250.

Referring to FIG. 2, the signal separation unit 210 separates input mono sound into a plurality of decorrelated signals, by dividing the input mono sound with respect to a frequency band or phase. For example, the signal separation unit 210 divides the input mono sound into a low frequency component signal and a high frequency component signal through low-pass filtering and high-pass filtering, respectively.

In order to form virtual sound sources at an arbitrary location, the asymmetric binaural synthesis unit 220 localizes each signal obtained by the signal separation unit 210 asymmetrically about a center of a front side of a listener head (i.e., at a listening point) by applying different head related transfer functions (HRTFs) to the respective signals. That is, the asymmetric binaural synthesis unit 220 arranges virtual speakers using the HRTF, asymmetrically about the center of the front side of the listener head. It should be understood that although the embodiments of the present general inventive concept are described with reference to the listener head, the listener, and the listening point, a listener need not actually be positioned at the listening point. This description is not intended to limit the scope of the present general inventive concept and is included only to demonstrate where a listener's head would typically be positioned when the mono sound reproducing system is being used.

The crosstalk canceller 230 cancels crosstalk between two actual speakers and two ears of the listener, with respect to the virtual sound sources generated in the asymmetric binaural synthesis unit 220. That is, the crosstalk canceller 230 cancels crosstalk of a signal reproduced in the left speaker 280-1 so that the left speaker signal is not heard by the right ear of the listener and cancels crosstalk of a signal reproduced in the right speaker 280-2 so that the right speaker signal is not heard by the left ear of the listener.

The left and right direct filters 240 and 250 are filters of $az^{-b}$, which have only gain and delay, adjust a signal characteristic between the input mono sound and the virtual sound sources output by the crosstalk canceller 230. Here, 'a' represents an output signal level and 'b' represents a time delay value that is obtained through an impulse response, phase characteristics, or listening experiments. That is, the left and right direct filters 240 and 250 generate natural sound by adjusting a difference of time delays and output levels between a virtual speaker output associated with the virtual sound source and is an actual speaker output.

Finally, the signals separated from the input mono sound and filtered by the left and right direct filters 240 and 250 and the virtual sound sources output by the crosstalk canceller 230 are combined and output respectively to the left and right speakers 280-1 and 280-2.

Figure 3:
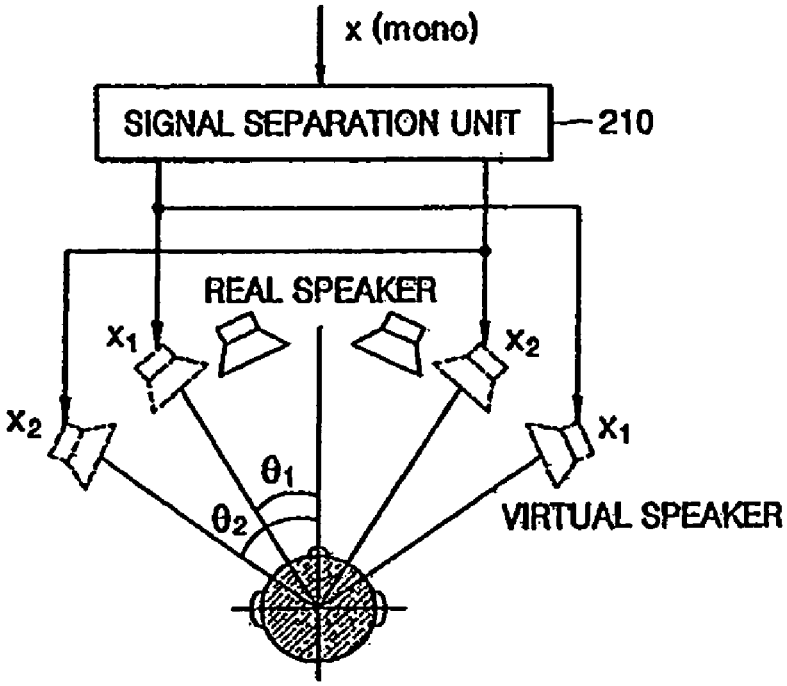
FIG. 3 is a conceptual diagram illustrating operation of the wide mono sound reproducing system of FIG. 2 according to an embodiment of the present general inventive concept.

FIG. 3 is a conceptual diagram illustrating operation of the wide mono sound reproducing system of FIG. 2 according to an embodiment of the present general inventive concept.

Referring to FIG. 3, an input mono sound signal (x) is divided into two different signals ($x_1$, $x_2$), decorrelated by a signal separation unit 210. The separated signals are reproduced through asymmetrically arranged virtual speakers. The virtual speakers are represented by dotted lines. Four virtual speakers may be formed by reflecting 4 HRTFs measured at different angles ($\theta_1$, $\theta_2$) from the center in front of the listener. Other numbers and/or asymmetrical arrangements of virtual speakers may also be used. That is, the separated signal ($x_1$) is reproduced through a virtual speaker positioned on a left-hand side line making a first angle ($\theta_1$) with respect to a center line of the listener (i.e., at the listening point), and a virtual speaker positioned on a right-hand side line making a second angle ($\theta_2$) with respect to the center line of the listener, and the separated signal ($x_2$) is reproduced through a virtual speaker positioned on a left-hand side line making the second angle ($\theta_2$) with respect to the center line of the listener, and a virtual speaker positioned on a right-hand side line making the first angle ($\theta_1$) with respect to the center line of the listener. Accordingly, the virtual speakers are arranged symmetrically from the center of the front side of the listener's head. However, each of the separate signals ($x_1$, $x_2$) are input to the virtual speakers asymmetrically about the center of the front side of the listener's head at the listening point.

Figure 4A:
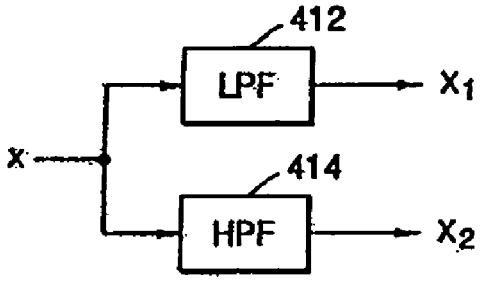
FIGS. 4A and 4B illustrate a signal separation unit of FIG. 2 according to different embodiments of the present general inventive concept.
Figure 4B:
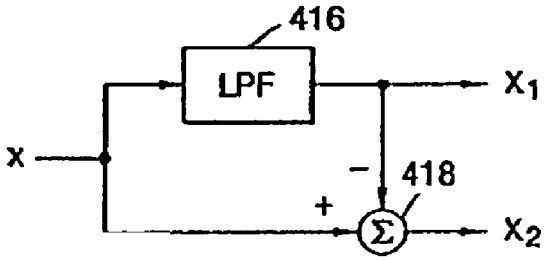

FIGS. 4A and 4B illustrate the signal separation unit 210 of FIG. 2 according to different embodiments of the present general inventive concept.

Referring to FIG. 4A, the mono sound signal (x) is separated into a low frequency component signal ($x_1$) and a high frequency component signal ($x_2$) by an LPF 412 and an HPF 414, respectively.

Referring to FIG. 4B, the mono sound signal (x) is separated into a low frequency component signal ($x_1$) and a signal ($x_2$) obtained by adding the original mono sound signal (x) and the low frequency component signal ($x_1$) through an LPF 416 and an adder 418, respectively. Either one of these embodiments may be used in the wide mono sound reproducing system.

Figure 5:
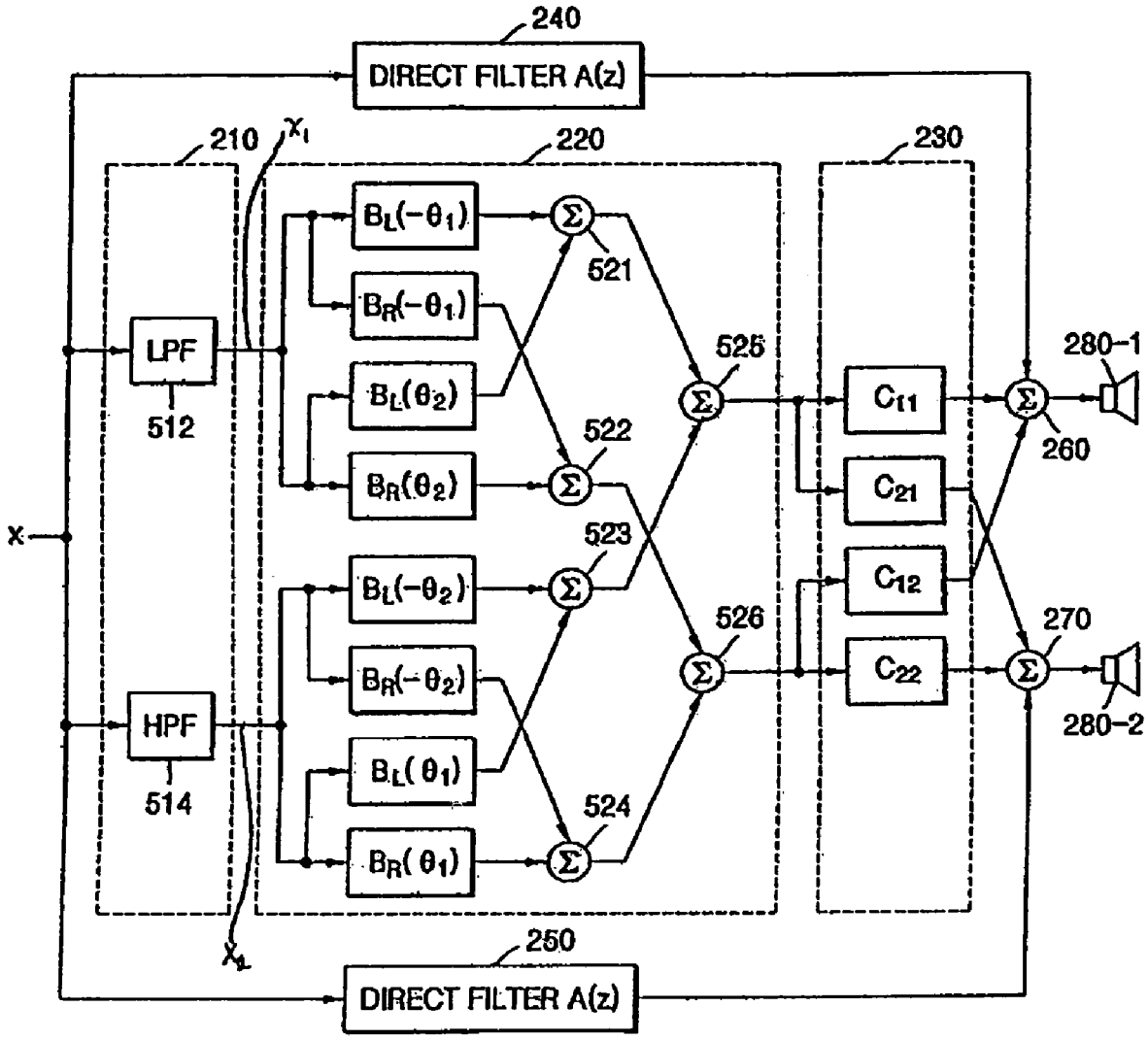
FIG. 5 is a detailed diagram of the wide mono sound reproducing system of FIG. 2.

FIG. 5 is a detailed diagram illustrating the wide mono sound reproducing system of FIG. 2 according to an embodiment of the present general inventive concept.

Referring to FIG. 5, the signal separation unit 210 can use an LPF 512 and an HPF 514 to divide an input mono signal sound (x) into bands. Accordingly, the input mono sound signal (x) is divided into two frequency bands by the LPF 512 and HPF 514.

The asymmetric binaural synthesis unit 220 has HRTFs ($B_L(-\theta_1)$, $B_R(-\theta_1)$, $B_L(\theta_2)$, $B_R(\theta_2)$, $B_R(-\theta_2)$, $B_L(-\theta_2)$, $B_L(\theta_1)$, $B_R(\theta_1)$), which are measured from positions on left-hand side and right-hand side lines making different angles with respect to the center line in front of the listener. The asymmetric binaural synthesis unit 220 localizes each signal separated by the signal separation unit 210 at virtual positions asymmetrical about the center of the front side of the listener's head by convolving the separated signals with the HRTFs. Here, $B_L(-\theta_1)$, and $B_R(-\theta_1)$ respectively represent an HRTF of the left ear and an HRTF of the right ear measured at a position on a left-hand side line making an angle $\theta_1$ from the front of the listener. Similarly, $B_L(\theta_2)$, and $B_R(\theta_2)$ respectively represent an HRTF of the left ear an HRTF of the right ear measured at a position on a right-hand side line making an angle $\theta_2$ from the front of the listener.

$B_R(-\theta_2)$, and $B_L(-\theta_2)$ respectively represent an HRTF of the left ear and an HRTF of the right ear measured at a position on a left-hand side line making an angle $\theta_2$ from the front of the listener. $B_L(\theta_1)$, and $B_R(\theta_1)$ respectively represent an HRTF of the left ear and an HRTF of the right ear measured at a position on a right-hand side line making an angle $\theta_1$ from the front of the listener. For example, if a sound source signal is convolved with $B_L(-\theta_1)$ and reproduced through a left channel, and convolved with $B_R(-\theta_1)$ and reproduced through a right channel, the listener perceives that the virtual sound source is on a line making an angle of $-\theta_1$ from the front of the listening point.

The signal passing through the LPF 512 is convolved with each of the HRTFs $B_L(-\theta_1)$, $B_R(-\theta_1)$, $B_L(\theta_2)$, and $B_R(\theta_2)$, and the signal passing through the HPF 514 is convolved with each of the HRTFs $B_R(-\theta_2)$, $B_L(-\theta_2)$, $B_L(\theta_1)$, and $B_R(\theta_1)$.

The signal convolved with $B_L(-\theta_1)$ is added to the signal convolved with $B_L(\theta_2)$ by an adder 521, and the signal convolved with $B_R(-\theta_1)$ is added to the signal convolved with $B_R(\theta_2)$ by adder 522. Also, the signal convolved with $B_L(-\theta_2)$ is added to the signal convolved with $B_L(\theta_1)$ by an adder 523, and the signal convolved with $B_R(-\theta_2)$ is added to the signal convolved with $B_R(\theta_1)$ by an adder 524. The output of the adder 521 and the output of the adder 523 are added by an adder 525 and output to a left channel. The output of the adder 522 and the output of the adder 524 are added by an adder 526 and output to a right channel.

Accordingly, the signal passing through the LPF 512 is reproduced through a virtual speaker positioned on the left-hand side line making the angle $\theta_1$ from the front of the listener, and a virtual speaker positioned on the right-hand side line making the angle $\theta_2$ from the front of the listener, and the signal passing through the HPF 514 is reproduced through a virtual speaker positioned on the left-hand side line making the angle $\theta_2$ from the front of the listener, and a virtual speaker positioned on the right-hand side line making the angle $\theta$, from the front of the listener. Accordingly, the signals passing through the LPF 512 and HPF 514 are localized at virtual positions asymmetrical about the center of the front side of the listener's head (i.e., at the listening point).

The crosstalk canceller 230 digital-filters two channel signals output from the asymmetric binaural synthesis unit 220, through transaural filter coefficients (($C_{11}(Z)$, $C_{21}(Z)$, $C_{12}(Z)$, $C_{22}(Z)$) to which a crosstalk cancellation algorithm is applied.

Although the system illustrated in FIG. 5 performs asymmetrical binaural synthesis of separated signals, the virtual speakers as a whole, as illustrated in FIG. 3, have a symmetrical arrangement. In other words, the same number of virtual speakers are output at each side of the listening point at the same positions on each side. Accordingly, if the symmetry of the HRTFs themselves as described below in equation 1 is used, and HRTFs having identical inputs and outputs are added before convolution is performed, the structure can be simplified as illustrated in FIG. 6 according to Equation (1) below.

$$B_L(\theta_1)=B_R(-\theta_1),\ B_R(\theta_1)=B_L(-\theta_1),\ B_L(\theta_2)=B_R(-\theta_2),\ B_R(\theta_2)=B_L(-\theta_2) \quad (1)$$

Figure 6:
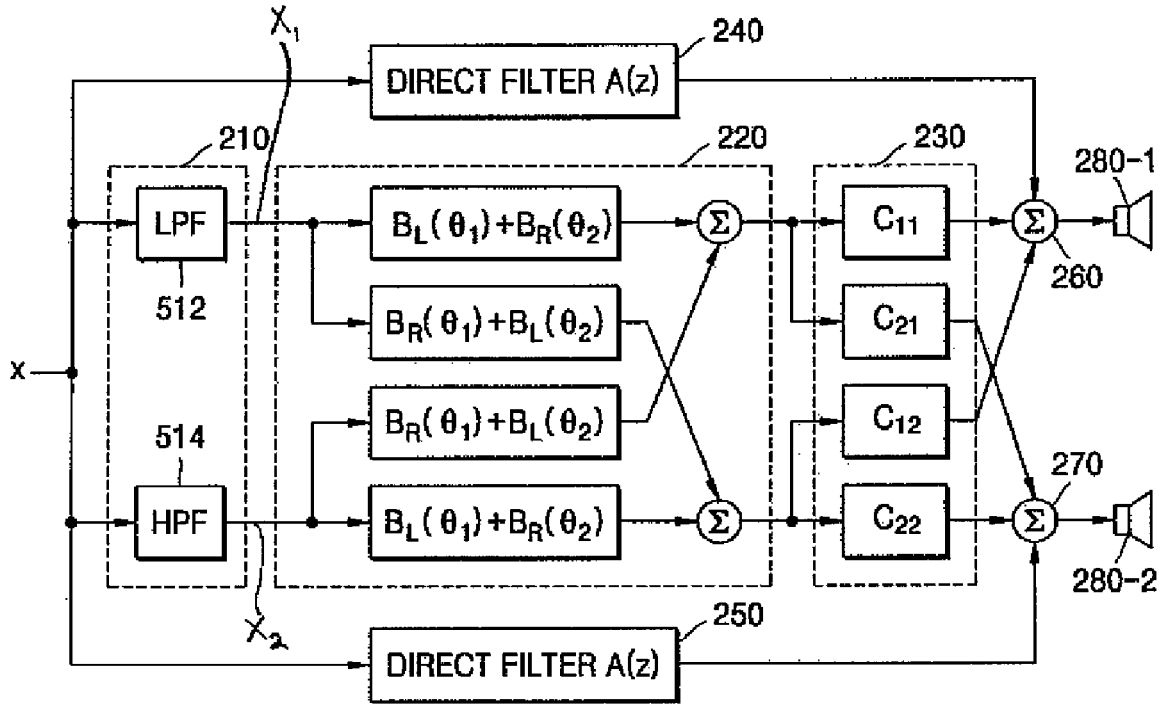
FIG. 6 is a simplified block diagram illustrating the wide mono sound reproducing system of FIG. 5 according to an embodiment of the present general inventive concept.

As illustrated in FIG. 6, because of the symmetrical arrangement of the virtual speakers, the asymmetric binaural synthesis unit 220 has a symmetrical structure as a whole, and as a result, a sound image can be prevented from leaning to one side. Also, since the two channel signals input to the asymmetric binaural synthesis unit 220 are different signals ($x_1$) and ($x_2$) obtained from the mono sound signal that passes respectively through the LPF 512 and the HPF 514, the two signals ($x_1$) and ($x_2$) do not generate a phantom image at the center in front of the listener.

Here, since coefficients of the asymmetric binaural synthesis unit 220 and the crosstalk canceller 230 do not change, they can be multiplied by each other to form a widening filter matrix as shown by the following equation (2):

$$\begin{bmatrix} W_{11} & W_{12} \\ W_{21} & W_{22} \end{bmatrix} = \begin{bmatrix} C_{11} & C_{12} \\ C_{21} & C_{22} \end{bmatrix} \begin{bmatrix} B_L(\theta_1)+B_R(\theta_2) & B_R(\theta_1)+B_L(\theta_2) \\ B_R(\theta_1)+B_L(\theta_2) & B_L(\theta_1)+B_R(\theta_2) \end{bmatrix} \quad (2)$$

where $W_{11}$, $W_{12}$, $W_{21}$, $W_{22}$ represent widening filter coefficients, $C_{11}$, $C_{12}$, $C_{21}$, $C_{22}$ represent crosstalk canceller coefficients, $B_L(\theta_1)$, and $B_R(\theta_1)$ respectively represent the HRTFs of the left ear and right ear measured on a right-hand side line making an angle $\theta_1$ from the center of the listener, and $B_L(\theta_2)$ and $B_R(\theta_2)$ respectively represent the HRTFs of the left ear and right ear measured on a right-hand side line making an angle ($\theta_2$) from the center of the listener.

Figure 7:
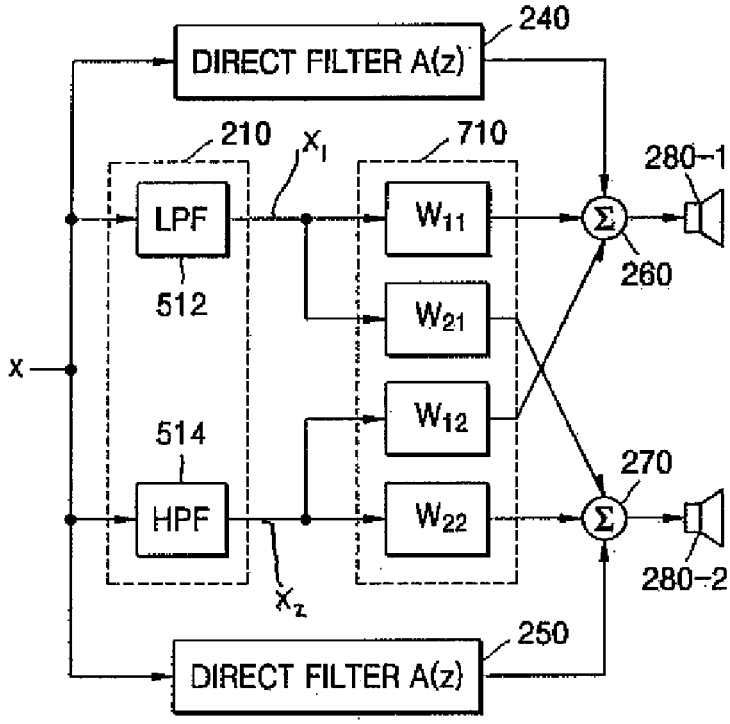
FIG. 7 is a block diagram illustrating a wide mono sound reproducing system obtained by optimizing the wide mono sound reproducing system of FIG. 6 according to an embodiment of the present general inventive concept.

FIG. 7 is a block diagram illustrating a wide mono sound reproducing system obtained by optimizing the asymmetric binaural synthesis unit 220 and the crosstalk canceller 230 of FIG. 6 using the widening filter matrix.

As illustrated in FIG. 7, by combining the asymmetric binaural synthesis unit 220 and the crosstalk canceller 230, a widening filter unit 710 is defined. If stereo sound passes through the widening filter unit 710 and is reproduced through two speakers, the listener perceives that the sound comes from virtual speakers spaced widely (i.e., a wide angle) in front of the listener (e.g., at $\theta_1$ and/or $\theta_2$). In this case, according to positions and a number of virtual speakers, widened stereo sound is perceived. However, since there may be a feeling of emptiness at the center where no virtual speaker is positioned, the listener may perceive an unstable feeling and the sound may be unnatural with a deteriorated timbre. To solve this problem, sound is also output through the actual left and right speakers 280-1 and 280-2 by defining the left and right direct filters 240 and 250. The left and right direct filters 240 and 250 adjust a magnitude and a time delay of the outputs of the actual speakers (i.e., the left and right speaker 280-1 and 280-2) and the virtual speakers. The time delay of the left and right direct filters 240 and 250 are set to the time delay of the widening filter 710 already designed, in order not to avoid changing the timbre. The left and right direct filters 240 and 250 also determine a ratio of output levels of the actual speakers and the virtual speakers. Accordingly, the left and right direct filters 240 and 250 can adjust a degree to which the stereo sound is separated. In an extreme case, if the magnitudes of the left and right direct filters 240 and 250 are almost 0, sound is reproduced only through the virtual speakers, and therefore the stereo sound stage is widened and there is no sound at the center. Alternatively, if the magnitudes of the left and right direct filters 240 and 250 are very large, sound is reproduced only through the actual speakers (i.e., the left and right speakers 280-1 and 280-2) and the wide stereo effect disappears. Accordingly, the magnitudes of the left and right direct filters 240 and 250 may be determined through listening experiments or sound tests according to a listener preference.

As illustrated in FIG. 7, the widening filter 710 is made to generate the virtual sound sources from the signals input through the two channels and output the sound to the virtual speakers, while the left and right direct filters (A(z)) 240 and 250 are made to adjust signal characteristics between the two channel signals and the virtual sound sources and output the sound to the actual speakers 280-1 and 280-2.

The present general inventive concept can be embodied as computer readable code on a computer readable recording medium. The computer readable recording medium may be any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the internet). The computer readable recording medium can also be distributed over network coupled computer systems so that the computer readable code is stored and executed in a distributed fashion.

According to embodiments of the present general inventive concept as described above, when mono sound is reproduced by a device having two speakers with a narrow spacing, for example, a PC, a TV, a notebook PC, or a cellular phone, the stereo sound stage may be widened.

Although the embodiments of the present general inventive concept are described with reference to two real (actual) speakers (e.g., 280-1 and 280-2), it should be understood that some embodiments of the present general inventive concept may be implemented using one real speaker. For example, in an embodiment relating to another sound reproducing system, such as a cellular phone, having a single front center speaker, a plurality of asymmetric virtual speakers can be arranged at a wide angle about the single front speaker.

Accordingly, by widening a sound stage by using an HRTF in relation to an input mono sound, a wider sound stage can be perceived than by the conventional method using a difference signal of the left and right signals.

Also, since a frequency band is divided and different HRTFs are transmitted asymmetrically, a change in timbre is smaller than when using the conventional method which generates left and right signals by changing the phases of the frequency bands.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of reproducing wide mono sound by a sound system, the method comprising:

separating an input mono sound signal into a plurality of decorrelated signals;

generating virtual sound sources by localizing the respective separated signals at virtual locations asymmetrical about a listening point by applying different head related transfer functions to the respective separated signals; and canceling crosstalk of the generated virtual sound sources.

2. The method of claim 1, further comprising:

performing a direct-filtering operation to adjust signal characteristics between the input mono sound signal and the crosstalk-cancelled virtual sound sources.

3. The method of claim 2, wherein the performing of the direct-filtering operation comprises determining the signal characteristics according to an output level and a time delay of the crosstalk-cancelled virtual sound sources.

4. The method of claim 1, wherein the separating of the input mono sound signal comprises dividing the input mono sound signal into frequency bands.

5. The method of claim 1, wherein the separating of the input mono sound signal comprises dividing the input mono sound signal into phases.

6. The method of claim 1, wherein the generating of the virtual sound sources comprises:

localizing a separated signal at different virtual locations on a left-hand side and on a right-hand side of the listening point, and localizing a second separated signal at different virtual locations on the left-hand side and on the right-hand side of the listening point such that the virtual locations of the second separated signal are symmetrical to the virtual locations at which the first separated signal is localized.

7. The method of claim 1, wherein the generating of the virtual sound sources comprises:

reproducing a separated first signal through a virtual speaker positioned on a left-hand side line making a first angle with a center line of the listening point and a virtual speaker positioned on a right-hand side line making a second angle larger than the first angle with the center line of the listening point; and reproducing a separated second signal through a virtual speaker positioned on a left-hand side line making the second angle with the center line of the listening point and a virtual speaker positioned on a right-hand side line making the first angle with the center line of the listening point.

8. A method of reproducing wide mono sound by a sound system, comprising:

separating an input mono sound signal into a plurality of decorrelated signals;

performing a widening filtering operation by generating virtual sound sources by localizing each of the separated signals at virtual locations asymmetrical about a center of a listening point by applying different head related transfer functions to the respective separated signals, and canceling crosstalk of the separated signals localized at the asymmetrical virtual locations; and performing a direct filtering operation to adjust signal characteristics between the input mono sound signal and the crosstalk-cancelled virtual sound sources.

9. The method of claim 8, wherein the widening filtering operation is performed by the following equation:

$$\begin{bmatrix} W_{11} & W_{12} \\ W_{21} & W_{22} \end{bmatrix} = \begin{bmatrix} C_{11} & C_{12} \\ C_{21} & C_{22} \end{bmatrix} \begin{bmatrix} B_L(\theta_1) + B_R(\theta_2) & B_R(\theta_1) + B_L(\theta_2) \\ B_R(\theta_1) + B_L(\theta_2) & B_L(\theta_1) + B_R(\theta_2) \end{bmatrix}$$

where $W_{11}$, $W_{12}$, $W2_1$, $W_{22}$ represent widening filter coefficients, $C_{12}$, $C_{21}$, $C_{22}$ represent crosstalk canceller coefficients, $B_L(\theta_1)$, and $B_R(\theta_1)$ respectively represent first HRTFs of a left ear and a right ear measured on a right-hand side line making an angle $\theta_1$ from a center of the listening point, and $B_L(\theta_2)$, and $B_R(\theta_2)$ respectively represent second HRTFs of the left ear and the right ear measured on a right-hand side line making an angle $\theta_1$ from the center of the listening point.

10. The method of claim 8, wherein the widening filtering operation comprises:

applying a first set of predetermined head related transfer functions (HRTFs) to a first one of the plurality of decorrelated signals to localize the first decorrelated signal at two or more asymmetric points with respect to the listening point;

applying a second set of predetermined HRTFs to a second one of the plurality of decorrelated signals to localize the second decorrelated signal at another two or more asymmetric points with respect to the listening point;

adding right ear components output from the applied first set of predetermined HRTFs to right ear components output from the applied second set of predetermined HRTFs to produce a right ear component signal;

adding left ear components output from the applied first set of predetermined HRTFs to left ear components output from the applied second set of predetermined HRTFs to produce a left ear component signal; and canceling cross talk between the right and left ear component signals using a predetermined matrix of cross talk cancellation coefficients.

11. The method of claim 10, wherein the first set of predetermined HRTFs comprises at least:

first and second HRTFs of left and right ears, respectively, to localize a portion of the first decorrelated signal at a first angle on a first side of the listening point; and third and fourth HRTFs of the left and right ears, respectively, to localize another portion of the first decorrelated signal at a second angle different from the first angle on a second side of the listening point.

12. The method of claim 8, wherein the widening filtering operation comprises:

applying a predetermined head related transfer function matrix having a plurality of coefficients that correspond to the virtual locations, positions of left and right ears, and characteristics of the left and right ears to localize at least a first one of the plurality of decorrelated signals at a first angle on a first side of the listening point and at a second angle different from the first angle on a second side of the listening point to determine left ear and right ear component signals of the localized first decorrelated signal; and canceling cross talk between the right and left ear component signals using a predetermined matrix of cross talk cancellation coefficients.

13. A wide mono sound reproducing system implemented as hardware to generate sound signals comprising:

a signal separation unit to separate an input mono sound signal into a plurality of decorrelated signals;

a binaural synthesis unit to generate virtual sound sources by localizing each of the separated signals at virtual locations asymmetrical about a center of a listening point by applying different head related transfer functions to the respective separated signals;

a crosstalk canceller unit to cancel crosstalk between the separated signals of the virtual sound sources localized at the virtual locations in the binaural synthesis unit based on a sound transfer function;

a direct filtering unit to adjust signal characteristics between the input mono sound signal and the virtual sound sources crosstalk-cancelled by the crosstalk canceller unit; and an output unit to add a signal output from the direct filtering unit with the virtual sound sources output from the crosstalk canceller unit and to output the added signals to left and right speakers.

14. The system of claim 13, wherein the signal separation unit comprises:

a low-pass filter to filter a low frequency component of the input mono sound signal; and a high-pass filter to filter a high frequency component of the input mono sound signal.

15. The system of claim 13, wherein an HRTF coefficient matrix of the binaural synthesis unit and a filter coefficient matrix of the crosstalk canceller unit are convolved to form a widening filter coefficient matrix as defined by the following equation:

$$\begin{bmatrix} W_{11} & W_{12} \\ W_{21} & W_{22} \end{bmatrix} = \begin{bmatrix} C_{11} & C_{12} \\ C_{21} & C_{22} \end{bmatrix} \begin{bmatrix} B_L(\theta_1) + B_R(\theta_2) & B_R(\theta_1) + B_L(\theta_2) \\ B_R(\theta_1) + B_L(\theta_2) & B_L(\theta_1) + B_R(\theta_2) \end{bmatrix}$$

where $W_{11}$, $W_{12}$, $W2_1$, $W_{22}$ represent widening filter coefficients, $C_{12}$, $C_{21}$, $C_{22}$ represent first crosstalk canceller coefficients, $B_L(\theta_1)$, and $B_R(\theta_1)$ respectively represent HRTFs of a left ear and a right ear measured on a right-hand side line making an angle $\theta_1$ from the center of the listener head position, and $B_L(\theta_2)$, and $B_R(\theta_2)$ respectively represent second HRTFs of the left ear and the right ear measured on a right-hand side line making an angle ($\theta_2$) from the center of the listener head position.

16. The system of claim 13, wherein the direct filtering unit comprises a filter to provide a gain and a delay to the input mono sound signal.

17. The system of claim 13, wherein the direct filtering unit comprises:

left and right filters to adjust a gain and delay of the input mono sound signal by separating the input mono sound signal into a left signal and a right signal and outputting the left and right signals.

* * * * *